US010610839B2

(12) United States Patent
Morrissey et al.

(10) Patent No.: US 10,610,839 B2
(45) Date of Patent: Apr. 7, 2020

(54) CONTAINER HAVING MAGNETIC IMPELLER ASSEMBLY WITH HOOD

(71) Applicant: EMD Millipore Corporation, Burlington, MA (US)

(72) Inventors: Martin Morrissey, Burlington, MA (US); Brian Pereira, Burlington, MA (US)

(73) Assignee: EMD Millipore Corporation, Burlington, MA (US)

( * ) Notice: Subject to any disclaimer, the term of this patent is extended or adjusted under 35 U.S.C. 154(b) by 13 days.

(21) Appl. No.: 15/954,779

(22) Filed: Apr. 17, 2018

(65) Prior Publication Data

US 2018/0229192 A1 Aug. 16, 2018

Related U.S. Application Data

(62) Division of application No. 14/403,373, filed as application No. PCT/US2013/068373 on Nov. 5, 2013, now Pat. No. 9,975,095.

(Continued)

(51) Int. Cl.
*B01F 13/08* (2006.01)
*B01F 15/00* (2006.01)

(Continued)

(52) U.S. Cl.
CPC ..... *B01F 7/00241* (2013.01); *B01F 7/162* (2013.01); *B01F 7/1635* (2013.01);

(Continued)

(58) Field of Classification Search
CPC .... B65D 77/06; B65D 21/086; B65D 90/205; B65D 88/68; B65D 37/00; B65D 88/16;

(Continued)

(56) References Cited

U.S. PATENT DOCUMENTS 1,580,476 A * 4/1926 Fassio ..... D06F 17/04 68/184
1,596,893 A * 8/1926 Schifter ..... E03C 1/262 4/287

(Continued)

FOREIGN PATENT DOCUMENTS

CN 101790414 A 7/2010
CN 102066238 A 5/2011

(Continued)

OTHER PUBLICATIONS

Indian communication dated Feb. 19, 2019 in corresponding Indian patent application No. 4300/DELNP/2015 (P-12/048-India).

(Continued)

*Primary Examiner* — Charles Cooley
(74) *Attorney, Agent, or Firm* — Nields, Lemack & Frame, LLC

(57) ABSTRACT

A disposable container, such as a deformable bag, for a fluid, having one or more inlets and one or more outlets and an impeller assembly within the container to cause mixing, dispersing, homogenizing and/or circulation of one or more ingredients contained or added to the container. The impeller assembly has a protective hood surrounding at least a portion of the moveable blades or vanes of the impeller assembly and being above at least a portion of the blades or vanes. The hood surrounds the blades or vanes and arcs over the height of the blades or vanes. The hood is shaped in a dome shape or semi-spherical shape that is around and above the impeller blades and acts as a protector for the container surface against the impeller assembly both during shipping and storage as well as when in use, particularly at lower liquid levels.

10 Claims, 6 Drawing Sheets

Related U.S. Application Data

(60) Provisional application No. 61/731,128, filed on Nov. 29, 2012.

(51) Int. Cl.
*B01F 7/00* (2006.01)
*B01F 7/16* (2006.01)

(52) U.S. Cl.
CPC ..... *B01F 13/0827* (2013.01); *B01F 13/0872* (2013.01); *B01F 15/0085* (2013.01); *B01F 2215/0032* (2013.01)

(58) Field of Classification Search
CPC .... B65D 83/0055; A61J 1/05; B01F 15/0085; B01F 7/163; B01F 15/00831; B01F 7/162; B01F 2215/0032; B01F 7/00241; B01F 13/0827; B01F 13/0872; B01F 7/1635; C12M 27/02; C12M 23/14; C12M 23/00
USPC ..... 366/273–274, 314, 348, 117, 118, 315, 366/317, 322–335; 435/302.1; 604/416, 604/903; 383/127; 416/3; 206/219–221, 206/818; 215/DIG. 3, DIG. 8
See application file for complete search history.

(56) References Cited

U.S. PATENT DOCUMENTS 1,918,509 A * 7/1933 Wilcox ..... E04D 13/0409 210/166
1,996,279 A * 4/1935 Dillon ..... E03C 1/264 4/292
3,984,001 A 10/1976 Nagano et al.
4,394,966 A * 7/1983 Snyder ..... B01F 5/0212 239/127
5,676,462 A 10/1997 Fraczek et al.
5,750,440 A * 5/1998 Vanell ..... B01F 13/0818 156/345.12
5,941,635 A 8/1999 Stewart
6,014,987 A * 1/2000 List ..... B64D 37/08 137/549
6,536,468 B1 * 3/2003 Wilmer ..... B01F 3/0857 137/544
7,153,021 B2 * 12/2006 Goodwin ..... B01F 13/0818 366/273
7,278,780 B2 * 10/2007 Goodwin ..... B01F 13/0818 366/273
7,481,572 B2 1/2009 Terentiev
7,762,716 B2 * 7/2010 Terentiev ..... B01F 7/162 366/273
8,079,492 B2 12/2011 Blomberg
8,282,267 B2 * 10/2012 Castillo ..... B01F 3/1221 366/262
9,550,157 B2 * 1/2017 Erdenberger ..... B01F 15/00714
9,744,507 B2 * 8/2017 Morrissey ..... C12M 23/14
9,975,095 B2 * 5/2018 Morrissey ..... B01F 7/162
10,471,401 B2 * 11/2019 Werth ..... B01F 13/0863
2004/0062140 A1 4/2004 Cadogan et al.
2006/0176772 A1 * 8/2006 Goodwin ..... B01F 13/0818 366/273
2007/0065312 A1 * 3/2007 Whitehouse ..... B01F 5/16 417/420
2007/0253287 A1 * 11/2007 Myhrberg ..... B01F 7/162 366/273
2009/0219780 A1 * 9/2009 Castillo ..... B01F 3/1221 366/132
2010/0012665 A1 * 1/2010 Morrissey ..... B65D 1/20 220/601
2011/0044567 A1 2/2011 Barbaroux et al.
2011/0127203 A1 * 6/2011 Morrissey ..... B01D 61/20 210/90
2011/0211418 A1 9/2011 Tassone et al.
2012/0027324 A1 2/2012 Morrissey et al.
2012/0155216 A1 * 6/2012 Morrissey ..... B01F 7/162 366/273
2014/0334249 A1 * 11/2014 Radow ..... B01F 13/0818 366/273
2015/0003189 A1 * 1/2015 Werth ..... B01F 7/00858 366/273
2015/0258513 A1 * 9/2015 Morrissey ..... C12M 23/14 366/265
2015/0298077 A1 * 10/2015 Morrissey ..... B01F 7/162 366/136
2017/0320027 A1 * 11/2017 Morrissey ..... B01F 7/00241
2018/0043322 A1 * 2/2018 Morrissey ..... B01F 7/00241

FOREIGN PATENT DOCUMENTS

CN 102350193 A 2/2012
EP 1731217 * 12/2006
EP 2259980 B1 2/2012
JP 2012-165764 A 9/2012
KR 10-2009-0069159 A 6/2009
WO 2008/040567 A1 4/2008
WO 2010/063845 A1 6/2010
WO WO-2014085034 A1 * 6/2014 ..... B01F 7/162

OTHER PUBLICATIONS

International Search Report/Written Opinion dated Apr. 4, 2014 in corresponding PCT application No. PCT/US2013/068373.
International Preliminary Report on Patentability dated Jun. 11, 2015 in corresponding PCT application No. PCT/US2013/068373.
Chinese communication, with English translation, dated Apr. 5, 2016 in corresponding Chinese patent application No. 201380062528.5.
Japanese communication, with English translation, dated May 10, 2016 in corresponding Japanese patent application No. 2015-545053.
European communication dated Jun. 27, 2016 in corresponding European patent application No. 13858562.5.

* cited by examiner

CONTAINER HAVING MAGNETIC IMPELLER ASSEMBLY WITH HOOD

This application is a divisional of U.S. patent application Ser. No. 14/440,373 filed May 4, 2015, which is a 371 of PCT/US2013/068373 filed Nov. 5, 2013, which claims priority of U.S. Provisional Application Ser. No. 61/731,128 filed on Nov. 29, 2012, the disclosures of which are incorporated herein by reference.

FIELD

The embodiments disclosed herein relate to a disposable container and impeller assembly, preferably magnetically driven and coupled to the container, and a hood surrounding at least a portion of the blades or vanes of the impeller assembly.

BACKGROUND

Traditionally, fluids have been processed in systems that utilize stainless steel containers. These containers are sterilized after use so that they can be reused. The sterilization procedures are expensive and cumbersome as well as being ineffectual at times.

In order to provide greater flexibility in manufacturing and reduce the time needed to effect a valid regeneration of the equipment, manufacturers have begun to utilize disposable sterilized bags that are used once with a product batch and then disposed.

An example of use of these disposable bags is in a system for mixing two or more ingredients, at least one of which is liquid and the other(s) being liquid or solid and the bag has a means for causing the ingredients to mix as uniformly as possible.

For example, in the production of vaccines, the liquids involved often contain aluminum salt as an adjuvant. The aluminum salt improves the effectiveness of the vaccine by enhancing the body's immune response. Unfortunately, the aluminum salt has particles sizes larger than 0.2 μm, and thus sterile filtering generally is not an option. As a result, it is often advantageous to minimize the number of containers into which the vaccine needs to be transferred, since each transfer represents a potential breach of sterility, and the resulting contamination can't be filtered away. Accordingly, it is advantageous to be able to mix vaccines in the same container, such as a flexible, disposable bag, that they are shipped in.

Another example is a bioreactor or fermentor in which cells are either in suspension or on microcarriers and the bag has a means for circulating the liquid, gases and in some cases the cells around the interior of the bag.

Most conventional mixing bags are shaped like cylinders, with the bottom of the bag forming a cone, to mimic the shape of the tanks that the disposable bags are replacing. Although this shape is conducive to mixing the contents of the bag, it is not conducive to shipping and storage.

Other conventional mixing bags are shaped like cubes. The cube shape is conducive to shipping and storage, but is not a good shape for mixing, as the corners of the cube easily can become dead spots where mixing is impeded.

Typically, the means for mixing or circulating is a magnetically coupled impeller contained within the bag and a magnetic motor outside the bag which remotely causes the impeller to spin. However, a problem with such 2D mixing bags is that the impellers of the mixer can contact and damage the opposing face of the bag, such as when the fluid level becomes low, or during initial shipment when the bag contains no fluid.

It therefore would be desirable to provide a disposable, preferably deformable, container for fluids having means for minimizing or preventing foaming at the container inlet and at the container outlet, that includes a mixing device that will not damage the container even when the liquid level in the container is low or the container is empty. In addition, it would be desirable to provide such a container wherein fluid entering the inlet is directed away from the outlet thereby to effect mixing of the incoming fluid with the fluid in the container.

SUMMARY

In accordance with certain embodiments, disclosed herein is a disposable container, such as a deformable bag, for a fluid having one or more inlets and one or more outlets and an impeller assembly within the container to cause mixing, dispersing, homogenizing and/or circulation of one or more ingredients contained or added to the container. In accordance with certain embodiments, the impeller assembly has a protective hood surrounding at least a portion of the moveable blades or vanes of the impeller assembly and being above at least a portion of the blades or vanes. In accordance with certain embodiments, the hood surrounds the blades or vanes and arcs over the height of the blades or vanes. Even more particularly, in certain embodiments the hood is shaped in a dome shape or semi-spherical shape that is around and above the impeller blades. The hood has one or more, preferably, two or more opening regions, preferably normal to the axis of the impeller, through which fluid can be pushed or pulled (depending upon the design and motion of the impeller blades or vanes) that allow for good fluid liquid circulation when the blades are in motion. The hood acts as a protector for the container surface against the impeller assembly both during shipping and storage as well as when in use, particularly at lower liquid levels. In addition, the hood can, in some embodiments, act as a vortex breaker especially at lower liquid levels so as to prevent foaming and to increase turbulence and therefore mixing efficiency. In certain embodiments the impeller is driven magnetically.

The hood can act as a vortex breaker when the upper surface of the hood is solid so it initially directs fluid away from the impeller assembly or the openings to the impeller assembly. The initial deflection of fluid away from the impeller assembly minimizes or prevents the formation of one or more vortices at the impeller.

In certain embodiments, the top surface of the hood has one or more apertures through which liquid can be pushed or pulled depending on the design and motion of the impeller blades or vanes.

Also disclosed is a system for mixing a fluid in a container, the system comprising a container, an impeller assembly member, and a drive for the impeller assembly.

Also disclosed is a method of mixing a fluid in a container with an impeller assembly that includes a protective hood. The method includes introducing a fluid into a container, wherein an impeller assembly is at least partially contained in and is sealed in the container, and driving the blades or vanes of the impeller assembly to agitate the fluid in the bag. The protective hood on the impeller assembly protects the bag from the blades, and breaks any vortex that may be formed by the rotating blades. In certain embodiments, the driver for the impeller assembly is external to the bag, and drives the impeller assembly magnetically.

Also disclosed is a fluid processing system which comprises a disposable container having one or more inlets and one or more outlets and an impeller assembly within the container to cause mixing, dispersing, homogenizing and/or circulation of one or more ingredients contained or added to the container, the impeller assembly having a protective hood surrounding at least a portion of the blades or vanes of the impeller assembly and being above at least a portion of the blades or vanes, and a tangential flow filtration unit and conduits to effect flow from the container to the tangential flow filtration unit and back to the container.

DETAILED DESCRIPTION OF SPECIFIC EMBODIMENTS

Figure 4:
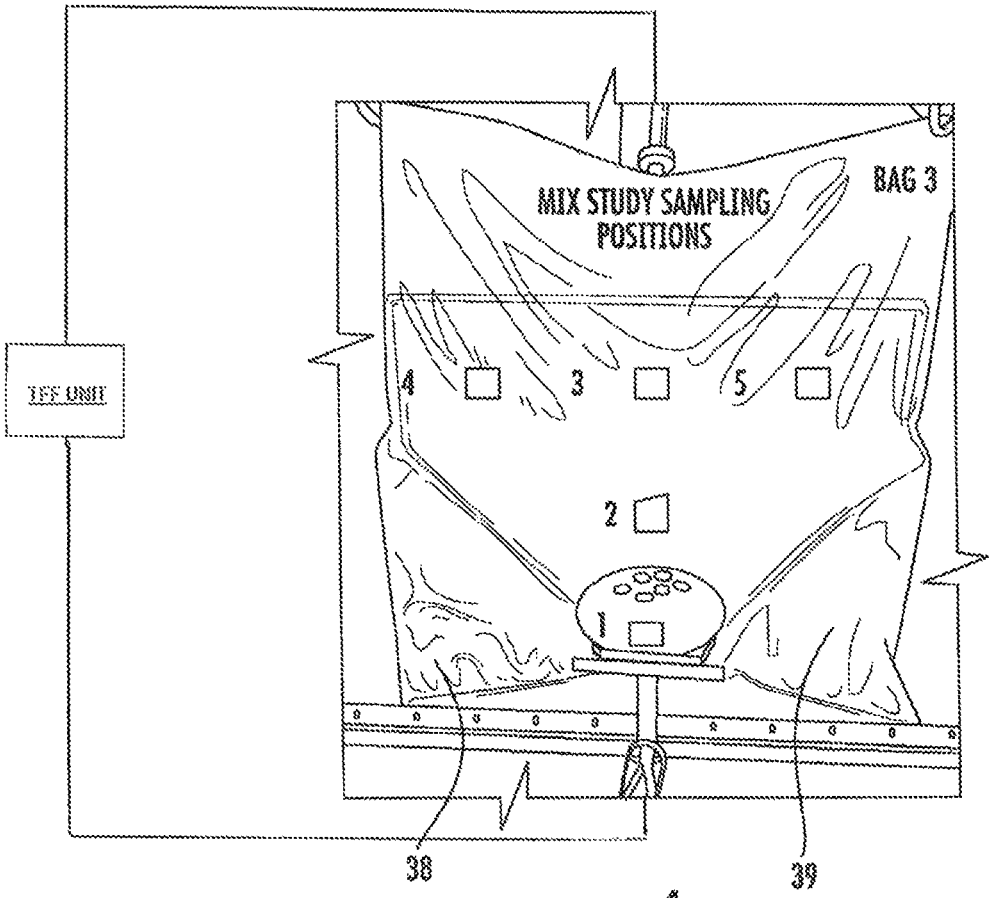
FIG. 4 is a front view of a container with an impeller assembly showing sampling positions in accordance with Example 1.

In accordance with certain embodiments, the disposable container designed to receive and hold a fluid can be formed of monolayer or multilayer flexible walls formed of a polymeric composition such as polyethylene, including ultrahigh molecular weight polyethylene, linear low density polyethylene, low density or medium density polyethylene; polyproplylene; ethylene vinyl acetate (EVOH); polyvinyl chloride (PVC); polyvinyl acetate (PVA); ethylene vinyl acetate copolymers (EVA copolymers); blends of various thermoplastics; co-extrusions of different thermoplastics; multilayered laminates of different thermoplastics; or the like. By "different" it is meant to include different polymer types such as polyethylene layers with one or more layers of EVOH as well as the same polymer type but of different characteristics such as molecular weight, linear or branched polymer, fillers and the like. Typically medical grade and preferably animal-free plastics are used. They generally are sterilizable such as by steam, ethylene oxide or radiation such as beta or gamma radiation. Most have good tensile strength, low gas transfer and are either transparent or at least translucent. Preferably the material is weldable and is unsupported. Preferably the material is clear or translucent, allowing visual monitoring of the contents. The container can be provided with one or more inlets, one or more outlets and one or more optional vent passages. Portions of the container can be sealed such as by welding to create regions where no fluid can flow, thereby modifying the shape of the volume of the container that receives fluid. An example is shown in FIG. 4, where lower left and right triangular portions 38, 39 of the container are sealed and are not in fluid communication with an inlet or outlet, and therefore contain no fluid to be mixed.

In certain embodiments, the container may be a disposable, deformable, foldable bag that defines a closed volume, that is sterilizable for single use, capable of accommodating contents, such as biopharmaceutical fluids, in a fluid state, and that can accommodate a mixing device partially or completely within the interior of the container. The closed volume can be opened, such as by suitable valving, to introduce a fluid into the volume, and to expel fluid therefrom, such as after mixing is complete.

The container may be a two dimensional or "pillow" bag, or it may be a three dimensional bag. The particular geometry of the container is not limited.

Each container contains, either partially or completely within its interior, an impeller assembly for mixing or circulating one or more liquids, gases and/or solids contained in the container. In accordance with certain embodiments, the impeller assembly includes one or more blades, which are movable, such as by rotation or oscillation about an axis. In certain embodiments, it converts rotational motion into a force that mixes the fluids it is in contact with. The impeller assembly has a protective hood formed over at least a part of the blades with a space contained between the under surface of the hood and the outer dimension of the blades so as to allow for free movement of the blades and liquid between the blades and the under surface of the hood.

Each container may contain one or more inlets and outlets and optionally other features such as sterile gas vents and ports for the sensing of the liquid within the container for parameters such as conductivity, pH, temperature, dissolved gases and the like.

In one embodiment, the disposable container is positioned within a solid support container for ease of filling and emptying the container of fluid.

Figure 1:
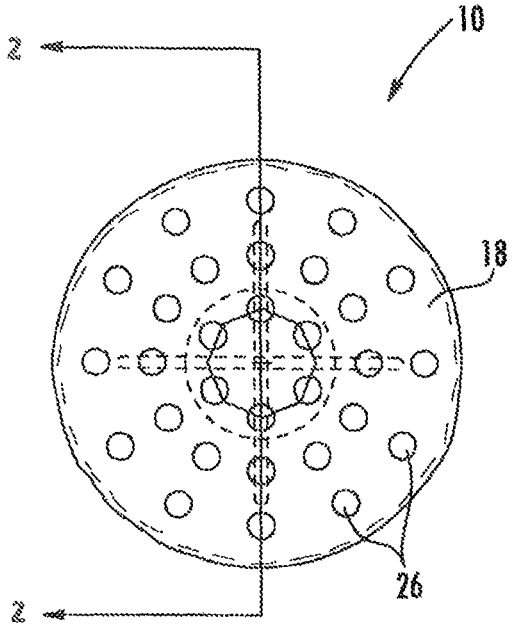
FIG. 1 is a top view of a mixing element in accordance with certain embodiments.
Figure 2:
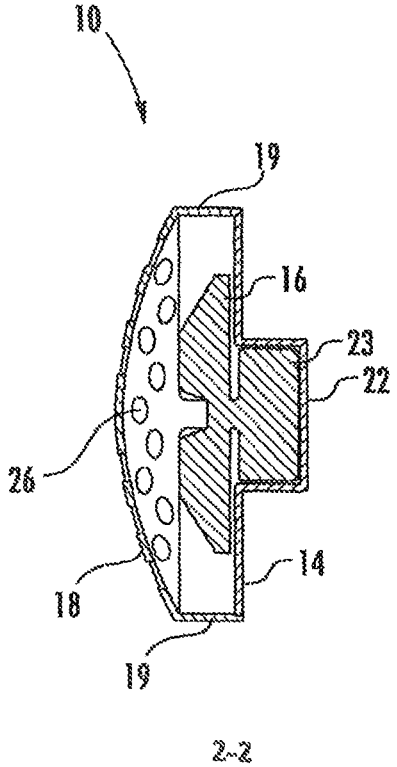
FIG. 2 is a cross sectional view of the mixing element taken along line A-A of FIG. 1.

Referring now to FIGS. 1 and 2, there is shown an impeller assembly 10 suitable for being positioned in a disposable container. The impeller assembly 10 includes a base 14, one or more moveable blades or vanes 16, and a protective hood 18. In certain embodiments, the protective hood 18 is coupled to the base with one or more ribs or legs 19. Where a plurality of ribs 19 is used, preferably they are equally spaced. The open regions between spaced ribs 19 are generally normal to the axis about which the impeller blades rotate, and provide fluid access to the interior of the impeller assembly. The number and shape of the blades 16 is not particularly limited, provided they provide sufficient agitation of the fluid within the container when actuated. The base 14 and hood 18 define a housing for the moveable blade or blades, and can be made of a suitable plastic material such as polyethylene, that does not react or otherwise interfere with the intended liquid contents of the container. The blade or blades may also be constructed of plastic material, such as polyethylene, or any polymer resistant to gamma irradiation, such as a polypropylene co-polymer.

Figure 3:
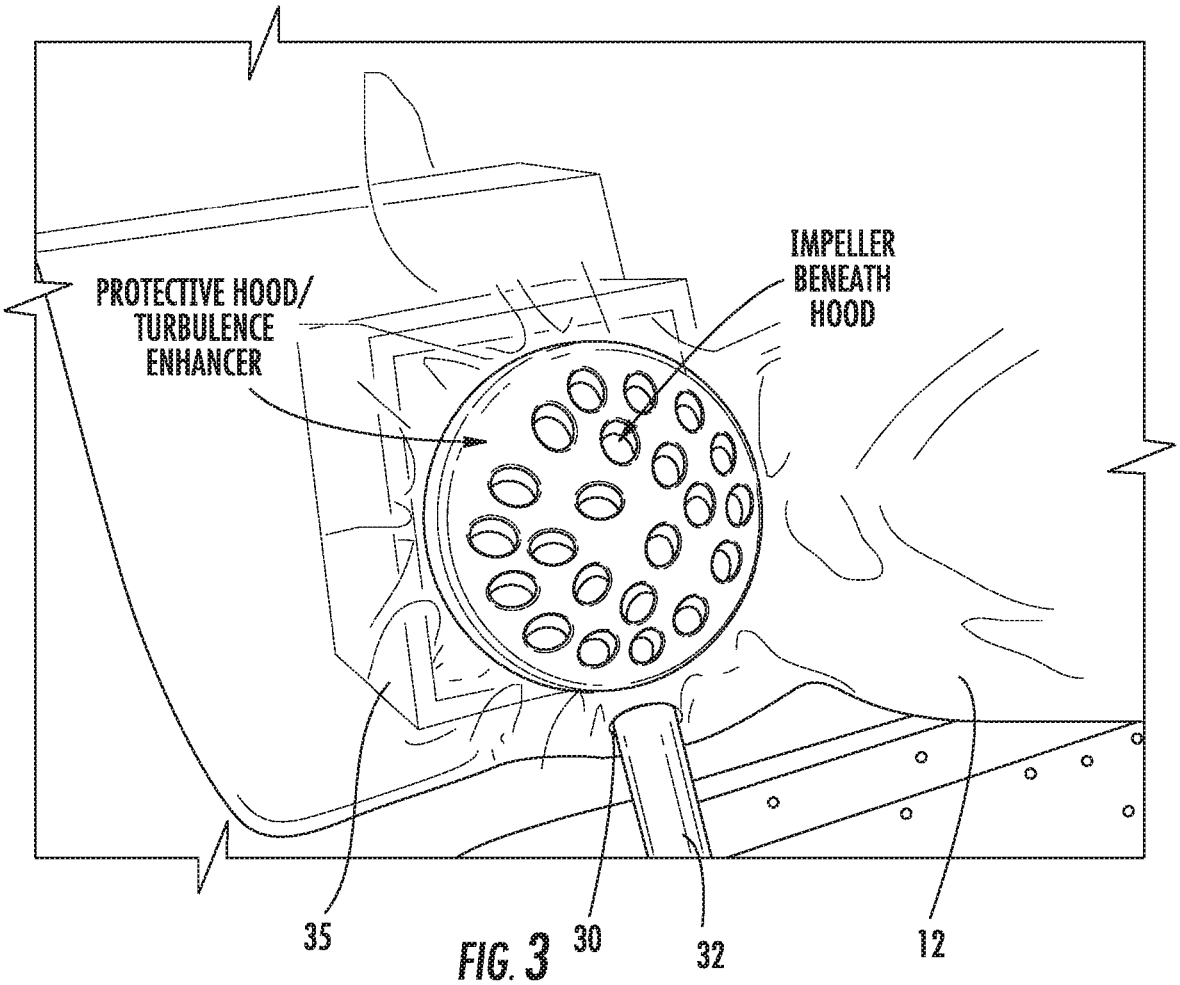
FIG. 3 is a perspective view of a mixing element within a 2D bag.

In certain embodiments, the base 14 includes an axially extending member 22 that accommodates the magnetic base of the impeller, such as a mixing impeller overmolded magnet 23, wherein the blades 19 extend axially above the member 22 where they are free to rotate when the magnetic impeller is drive by a drive magnet. In certain embodiments, when the impeller assembly 10 is installed in the disposable container 12, the extending member 22 protrudes outside the container 12 and it and/or the base 14 is sealed to the container 12. The remainder of the impeller assembly 10 is housed inside the container 12. Preferably the impeller assembly is positioned at or near the bottom of the container, when the container is in mixing position (such as a hanging position) and in close proximity to an inlet 30 of the container (FIG. 3).

The protective hood 18 is positioned over the impeller assembly 10, and protects the container from damage from contact with the blades 16 during shipping, storage and during use. The hood 18 also serves to break any vortex that may be formed during mixing, and thereby increases the turbulence during mixing. Enhanced mixing is thus achieved.

In certain embodiments, the hood 18 is of a dome or semi-spherical shape and is positioned around and above the impeller blades 16, with the axial distance from the base 14 to the underside of the hood increasing as the center of the hood 18 is approached. The hood 18 must be shaped and positioned over the blades 16 such that the blades, whether stationary or moving, do not contact the hood 18. In certain embodiments, the hood 18 is tapered in smooth transition so as to not create a sharp or cutting edge that could damage the container.

The top surface of the hood 18 should be smooth to avoid damaging the container upon contact with the hood. In certain embodiments, the top surface of the hood 18 includes a plurality of spaced apertures 26 formed therein, to allow fluid passage to and from the interior of the impeller assembly 10. In the embodiment shown in FIG. 1, a first ring of spaced apertures is located near the outer circumferential edge of the top surface, a second ring of spaced apertures is located radially inwardly of the first ring, and a third ring of apertures is located radially inwardly of the second ring. In the embodiment shown in FIG. 1, the first ring of spaced apertures includes 12 apertures; the second ring of spaced apertures includes 12 apertures, and the third ring of spaced apertures includes 6 apertures. Those skilled in the art will appreciate that the particular number and pattern of apertures is not limited to the embodiment shown in FIG. 1. Although in the embodiment shown, each aperture within a ring is equally sized and is generally circular, the shape and diameter of the apertures is not limited. FIG. 3 shows a different pattern of apertures where the placement of apertures radially inwardly of the outer circumferential ring is more randomized. The apertures can be formed by a variety of means, such as by drilling.

Preferably the hood is dome shaped to protect the container, and the assembly has side openings to pull liquid in, and openings in the hood to propel liquid out. In general, the amount of open area in the hood is a trade-off between the ability of the hood to protect the bag from damage, and the mixing efficiency of the impeller assembly. For the unit to work efficiently, it needs to be able to pull fluid in from the side openings in the hood (i.e. the spaces between the legs). It also needs to be able to propel the fluid out through the top (hence the need for the apertures in the hood). The more open area on top, the better the mixing efficiency. However, if the size of the apertures is too large, the container material could sag through them and touch the impeller, damaging the container.

In the embodiment shown in FIG. 3, the disposable container 12 is made of weldable plastic such as polyethylene, and is sealed. Fluid access into the interior of the container 12 is via an inlet 30 that is sealed to a first conduit 32, and fluid access out of said container is via an outlet (not shown) that is sealed to a second conduit (not shown).

In certain embodiments, at least a portion of the impeller assembly is internal to the container, and the driver 35 for the impeller assembly is external to the container 12.

Figure 5:
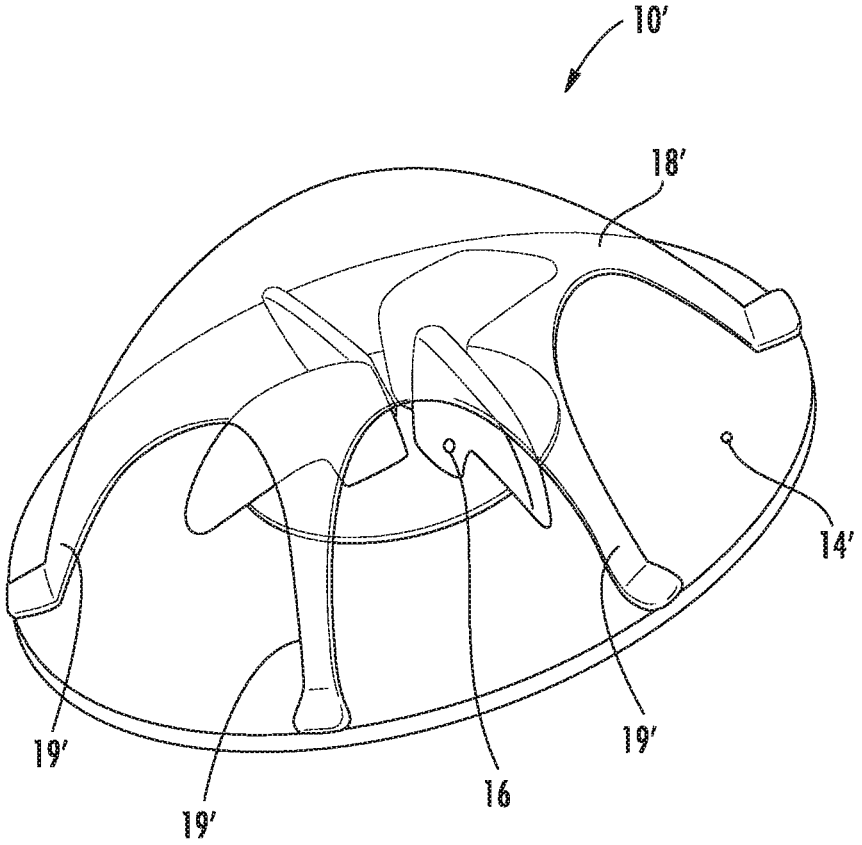
FIG. 5 is a perspective view of a mixing element in accordance with another embodiment.
Figure 6:
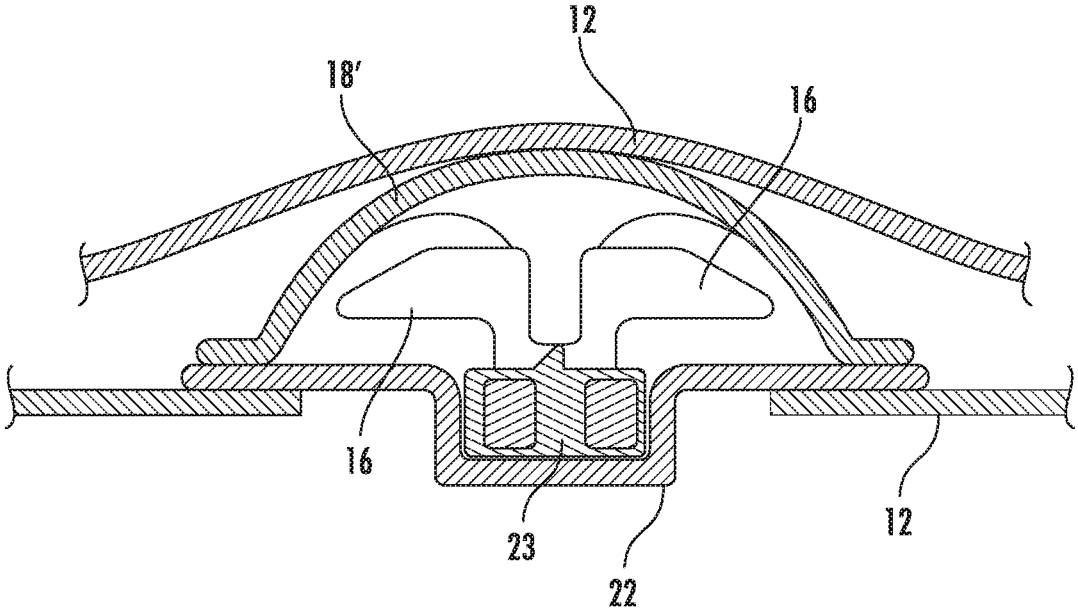
FIG. 6 is a cross-sectional view of the mixing element of FIG. 5.

FIGS. 5 and 6 show another embodiment of an impeller assembly 10'. In this embodiment, the ribs or legs 19' extend upwardly from the base 14' higher than in the embodiment of FIG. 1, and the regions between base 14' legs 19' and the hood 18' are larger than in the embodiment of FIG. 1. Fluid then enters and exits the interior of the impeller assembly 10' through these regions, and apertures in the surface of the hood 18' itself are not provided. FIG. 6 shows the container 12 (in this case, film) sealed to the base 14' and opposing the face of the hood 18'. Contact between the container and the blades 16 is avoided.

In operation, the impeller assembly is sealed in the interior of the container, with the axially extending member 22 positioned outside the interior of the container. A conduit is connected to an inlet of the container, the inlet preferably positioned near the impeller assembly. The ingredients to be mixed are introduced into the container via the conduit and inlet. An external impeller drive is used to actuate the blades of the impeller assembly to initiate mixing of the container contents. When the desired mixing is achieved, the contents are withdrawn from the container via one or more outlets.

Example 1

Optical density measurements were used to assess the ability of the impeller assembly to homogenize $CaCO_3$ after different sedimentation times. The effect of mixing time was determined, and mixing at different mixing positions in the bag was characterized.

Procedure: The bag was placed on an Ohaus weigh scale and zeroed. 150 g of $CaCO_3$ was added to a 500 ml beaker, then poured into the bag. RO water was added to the bag until the weight was 10 Kg. The bag was hung on a mix stand. 1×1" squares of silicone were cut and attached to the outer surface of the bag at the following five locations: on the centerline, start 2" up from the outlet (position 1), 4" above this is position 2, 4" above this is position 3, 5" to the left of 3, is position 4. 5" to the right of 3 is position 5 (see FIG. 4). The contents of the bag were allowed to settle, and the settling time was recorded.

The mixer was started at 800 rpm (80% of Max), and the stop watch was started.

15 ml. samples were taken with separate syringes from each of the 5 locations at the following times: 2 minutes, 11 minutes, and 20 minutes. Each of the samples was deposited in a labeled 15 ml vial. The syringes were thoroughly rinsed between samples.

The vials shaken thoroughly and then were measured in a turbidity meter.

This procedure was run after 2 hours settling time and after 20 hours settling time.

Results:

TABLE 1

| Vial ID | Settle | Time (hrs) | Mix Time (min) | Position NTU |
|---|---|---|---|---|
| 2-1 | 2 | 2 | 1 | 295 |
| 2-2 | 2 | 2 | 2 | 331 |
| 2-3 | 2 | 2 | 3 | 335 |
| 2-4 | 2 | 2 | 4 | 279 |
| 2-5 | 2 | 2 | 5 | 320 |
| 11-1 | 2 | 11 | 1 | 323 |
| 11-2 | 2 | 11 | 2 | 348 |
| 11-3 | 2 | 11 | 3 | 340 |
| 11-4 | 2 | 11 | 4 | 297 |
| 11-5 | 2 | 11 | 5 | 321 |
| 20-1 | 2 | 20 | 1 | 321 |

TABLE 1-continued

| Vial ID | Settle | Time (hrs) | Mix Time (min) | Position NTU |
|---|---|---|---|---|
| 20-2 | 2 | 20 | 2 | 362 |
| 20-3 | 2 | 20 | 3 | 290 |
| 20-4 | 2 | 20 | 4 | 336 |
| 20-5 | 2 | 20 | 5 | 273 |
| 2-1 | 20 | 2 | 1 | 476 |
| 2-2 | 20 | 2 | 2 | 325 |
| 2-3 | 20 | 2 | 3 | 330 |
| 2-4 | 20 | 2 | 4 | 325 |
| 2-5 | 20 | 2 | 5 | 301 |
| 11-1 | 20 | 11 | 1 | 326 |
| 11-2 | 20 | 11 | 2 | 342 |
| 11-3 | 20 | 11 | 3 | 328 |
| 11-4 | 20 | 11 | 4 | 340 |
| 11-5 | 20 | 11 | 5 | 348 |
| 20-1 | 20 | 20 | 1 | 347 |
| 20-2 | 20 | 20 | 2 | 298 |
| 20-3 | 20 | 20 | 3 | 336 |
| 20-4 | 20 | 20 | 4 | 294 |
| 20-5 | 20 | 20 | 5 | 347 |

Discussion

The foregoing results were analyzed with Minitab's (version 16) Balanced ANOVA procedure. ANOVA is an acronym for the statistical analysis technique known as ANalysis Of VAriance. Below is the resulting ANOVA table:

TABLE 2

Analysis of Variance for NTU

| Source | DF | SS | MS | F | P |
|---|---|---|---|---|---|
| Settle Time (hrs) | 1 | 2842 | 2842 | 2.18 | 0.154 |
| Mix Time (min) | 2 | 822 | 411 | 0.31 | 0.733 |
| Position | 4 | 4782 | 1195 | 0.92 | 0.472 |
| Error | 22 | 28723 | 1306 | | |
| Total | 29 | 37169 | | | |

S = 36.1328
R-Sq = 22.72%
R-Sq (adj) = 0.00%

For a variable to be considered to have an effect that is statistically significantly greater than the general noise level inherent in the data (known as "Error"), it should have a "P" value of 0.050 or lower. The lower the "P" value, the more significant the variable.

Neither Settle Time nor Mix Time nor Position (in the bag) approached statistical significance, as can be seen from their high "P" values (Settle Time=0.154, Mix Time=0.733, Position=0.472). All were much higher than 0.050.

The insignificance of the effect of mixing time and position in the bag is also indicated by the low coefficient of determination ($R^2$). This figure estimates the % of variation in the data that is explained by the model NTU=f(settling time, mixing time, position in bag). The $R^2$ indicates that 0.00% of the variation could be explained by the 3 variables.

Conclusion

1. At 2 minutes, the $CaCO_3$ is completely mixed in the bag, whether it settled for 2 hours or 20 hours. Further mixing does not result in better homogenization of the mix.
2. The homogenization was evenly distributed over all positions in the bag.

Example 2

Range of Mixing Volumes

Purpose: Determine the lowest level of mixing in the bag.

Procedure: The same bag filled with the $CaCO_3$ solution that was used in Example 1 was used to prevent any variation due to preparation. The solution was mixed for 2 minutes. The bag was drained to about the 1 L level. The bag was removed from the mixer and its weight confirmed.

The bag was re-hung, and allowed to continue to drain until splashing occurred, wherein draining was stopped. The bag was re-weighed to determine the splash level, and the settling time was recorded.

Results:

The bag was drained to 1.050 Kg. No splashing occurred. The bag continued draining to 0.496 Kg. Splashing and foaming were obvious.

Conclusion

The impeller can continue to operate down to 0.75 L.

Example 3

Purpose: Demonstrate that mixing occurs at 500 rpm (50% of maximum capacity) and 800 rpm (80%).

Procedure: A bag was placed on an Ohaus weigh scale and zeroed. 150 g of $CaCO_3$ was added to a 500 ml beaker, then poured it into the bag. RO water was added to the bag until the weight is 10 Kg. The bag was hung on a mix stand.

1×1" squares of silicone were cut and attached to the bag at the following five positions: On the centerline, 2" up from the outlet (position 1), 4" above this (position 2), 4" above this (position 3), 5" to the left of position 3 (position 4) and 5" to the right of position 3 (position 5).

Settling time was recorded.

The mixer was started at 500 rpm (50% of Max), and the stop watch was started.

Samples were taken from each of the 5 locations at the following times: 2 minutes, 11 minutes, and 20 minutes. 15 ml samples were taken with a syringe and deposited in a labeled 15 ml vial. Multiple syringes were used to collect the samples from the different positions. The syringes were thoroughly rinsed between samples.

The vials were thoroughly shaken and then placed a turbidity meter and measured.

The foregoing procedure was run after 20 hours settling, and the results were compared to the 20 hr settling data from Example 1. These data were collected while the mixer was spinning at 800 rpm.

Results:

| | Settle Time | Mix | Speed | | |
|---|---|---|---|---|---|
| Vial ID | hr | Time min | Position | RPM | NTU |
| 2-1 | 20 | 2 | 1 | 80 | 326 |
| 2-2 | 20 | 2 | 2 | 80 | 325 |
| 2-3 | 20 | 2 | 3 | 80 | 330 |
| 2-4 | 20 | 2 | 4 | 80 | 325 |
| 2-5 | 20 | 2 | 5 | 80 | 301 |
| 11-1 | 20 | 11 | 1 | 80 | 326 |
| 11-2 | 20 | 11 | 2 | 80 | 342 |
| 11-3 | 20 | 11 | 3 | 80 | 328 |
| 11-4 | 20 | 11 | 4 | 80 | 340 |
| 11-5 | 20 | 11 | 5 | 80 | 348 |
| 20-1 | 20 | 20 | 1 | 80 | 347 |
| 20-2 | 20 | 20 | 2 | 80 | 298 |
| 20-3 | 20 | 20 | 3 | 80 | 336 |
| 20-4 | 20 | 20 | 4 | 80 | 294 |
| 20-5 | 20 | 20 | 5 | 80 | 347 |

-continued

| Vial ID | Settle Time hr | Mix Time min | Speed Position | Speed RPM | NTU |
|---|---|---|---|---|---|
| 2-1 | 20 | 2 | 1 | 50 | 301 |
| 2-2 | 20 | 2 | 2 | 50 | 326 |
| 2-3 | 20 | 2 | 3 | 50 | 304 |
| 2-4 | 20 | 2 | 4 | 50 | 315 |
| 2-5 | 20 | 2 | 5 | 50 | 340 |
| 11-1 | 20 | 11 | 1 | 50 | 279 |
| 11-2 | 20 | 11 | 2 | 50 | 364 |
| 11-3 | 20 | 11 | 3 | 50 | 290 |
| 11-4 | 20 | 11 | 4 | 50 | 338 |
| 11-5 | 20 | 11 | 5 | 50 | 322 |
| 20-1 | 20 | 20 | 1 | 50 | 336 |
| 20-2 | 20 | 20 | 2 | 50 | 312 |
| 20-3 | 20 | 20 | 3 | 50 | 266 |
| 20-4 | 20 | 20 | 4 | 50 | 320 |
| 20-5 | 20 | 20 | 5 | 50 | 292 |

The above results were analyzed with Minitab's (version 16) Balanced ANOVA procedure. ANOVA is an acronym for the statistical analysis technique known as ANalysis Of VAriance. Below is the resulting ANOVA table:

Results for: Only 20 hr Settling
ANOVA: NTU versus Mix Time (min), Position, Speed

| Factor | Type | Levels | Values |
|---|---|---|---|
| Mix Time (min) | fixed | 3 | 2, 11, 20 |
| Position | fixed | 5 | 1, 2, 3, 4, 5 |
| Speed | fixed | 2 | 50, 80 |

Analysis of Variance for NTU

| Source | DF | SS | MS | F | P |
|---|---|---|---|---|---|
| Mix Time (min) | 2 | 1967 | 984 | 0.76 | 0.479 |
| Position | 4 | 3832 | 958 | 0.74 | 0.574 |
| Speed | 1 | 4272 | 4272 | 3.31 | 0.083 |
| Error | 22 | 28420 | 1292 | | |
| Total | 29 | 38491 | | | |

S = 35.9420
R-Sq = 26.16%
R-Sq(adj) = 2.67%

For a variable to be considered to have an effect that is statistically significantly greater than the general noise level inherent in the data (known as "Error"), it should have a "P" value of 0.050 or lower. The lower the "P" value, the more significant the variable.

Neither Mix Time nor Position (in the bag) nor Mixing Speed were of statistical significance, as can be seen from their "P" values (Mix Time=0.479, Position=0.574, Speed=0.083). All were higher than the 0.050 critical value for statistical significance. However, Mixing speed got close. Therefore, Mixing speed was scrutinized further. The graph in FIG. 7 shows NTUs graphed by Mixing speed.

Figure 7:
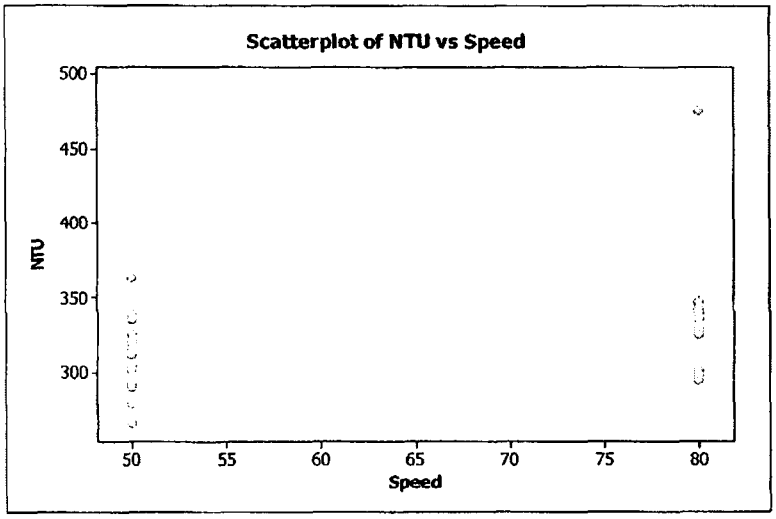
FIG. 7 is a graph of NTU's vs. mixing speed.

It is clear from the graph in FIG. 7 that Mixing Speed came close to achieving statistical significance, because of one outlying data point. This vial was rechecked, but still high at 455 NTUs. No smudges were evident on the vial. The fact that it was cloudier was confirmed by visual observation.

The insignificance of the effect of mixing time, position, and speed is also indicated by the low coefficient of determination ($R^2$). This figure estimates the % of variation in the data that is explained by the model NTU=f(mixing time, position, speed). The $R^2$ indicates that 2.67% of the variation could be explained by the 3 variables.

Conclusion

The $CaCO_3$ was equally well mixed at 50% speed (500 rpm) as it was at 80% speed (800 rpm).

What is claimed is:

1. A method of mixing fluid within a container, comprising:

providing a container for a fluid comprising a closed volume formed of a foldable flexible material, one or more inlets, one or more outlets, and an impeller assembly mounted at least partially within said closed volume, said impeller assembly comprising a plurality of spaced legs, the spaces between the plurality of spaced legs defining side openings between the legs, at least one moveable blade and a dome-shaped or semi-spherical shaped protective hood having a top surface, the protective hood being positioned over and around said at least one blade such that when said folded flexible material is in a folded state, said protective hood protects said folded flexible material from damage by said at least one blade, said impeller assembly sealed to said container;

introducing fluid to be mixed in said container; and actuating said at least one moveable blade; wherein actuation of said at least one moveable blade pulls said fluid into the impeller assembly through said side openings.

2. The method of claim 1, wherein said at least one movable blade is actuated magnetically.

3. The method of claim 1, wherein the positioning of said hood over and around said at least one blade is such that said at least one blade does not contact said hood.

4. The method of claim 1, wherein the positioning of said hood over and around said at least one blade is such that said at least one blade does not contact said container.

5. The method of claim 1, wherein said impeller assembly is magnetically driven.

6. The method of claim 1, wherein the container of claim 1 is in fluid communication with a fluid processing system having a tangential flow filtration unit and conduits to effect flow from said container to said tangential flow filtration unit and back to said container.

7. The method of claim 1, wherein the hood increases a mixing efficiency and/or turbulence.

8. The method of claim 1, wherein the hood protects the container during processing of low liquid levels.

9. The method of claim 1, wherein the container is protected from the impeller assembly whether said container is a pillow bag, a two-dimensional or a three dimensional bag.

10. The method of claim 1, wherein the impeller assembly further comprises a base to which the hood is coupled.

* * * * *